US006494029B2

(12) United States Patent
Jaschke et al.

(10) Patent No.: US 6,494,029 B2
(45) Date of Patent: Dec. 17, 2002

(54) YARN TEXTURING MACHINE

(75) Inventors: Klemens Jaschke, Hückeswagen (DE); Andreas Schulz, Ratingen (DE); Dietrich Berges, Marienheide (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 10/052,044

(22) Filed: Jan. 17, 2002

(65) Prior Publication Data

US 2002/0056266 A1 May 16, 2002

Related U.S. Application Data

(62) Division of application No. 09/590,237, filed on Jun. 8, 2000, which is a continuation of application No. PCT/EP99/07289, filed on Oct. 1, 1999.

(30) Foreign Application Priority Data

Oct. 12, 1998 (DE) ..... 198 46 948
Oct. 27, 1998 (DE) ..... 198 49 392

(51) Int. Cl.[7] ..... D01H 13/04
(52) U.S. Cl. ..... 57/280; 57/279; 57/352
(58) Field of Search ..... 57/279, 280, 287, 57/288, 289, 310, 352; 28/268, 272, 240

(56) References Cited

U.S. PATENT DOCUMENTS

| | | | | | |
|---|---|---|---|---|---|
| 3,645,081 | A | * | 2/1972 | Salama | 57/288 |
| 3,772,869 | A | * | 11/1973 | Mutschler et al. | 57/106 |
| 4,058,691 | A | | 11/1977 | Kubler | |
| 4,246,750 | A | * | 1/1981 | Norris et al. | 57/293 |
| 5,896,976 | A | | 4/1999 | Jaschke | 57/352 |
| 5,924,272 | A | | 7/1999 | Jaschke et al. | 57/279 |
| 6,209,302 | B1 | | 4/2001 | Wortmann et al. | |

FOREIGN PATENT DOCUMENTS

| | | |
|---|---|---|
| DE | 196 52 620 A1 | 6/1997 |
| EP | 0 460 799 A1 | 12/1991 |
| WO | WO 98/33963 A1 | 8/1998 |

* cited by examiner

*Primary Examiner*—John J. Calvert
*Assistant Examiner*—Shaun R Hurley
(74) *Attorney, Agent, or Firm*—Alston & Bird LLP

(57) ABSTRACT

A yarn texturing machine for texturing a plurality of thermoplastic yarns, each in a processing station. The yarns are guided and advanced in each processing station by a plurality of feed systems. One of the feed systems comprises a driven feed roll which is partially looped by the advancing yarn, and a guide member mounted for movement relative to the feed roll for movement between a threading position wherein the yarn is separated from the feed roll and an operating position wherein the yarn engages the feed roll.

12 Claims, 10 Drawing Sheets

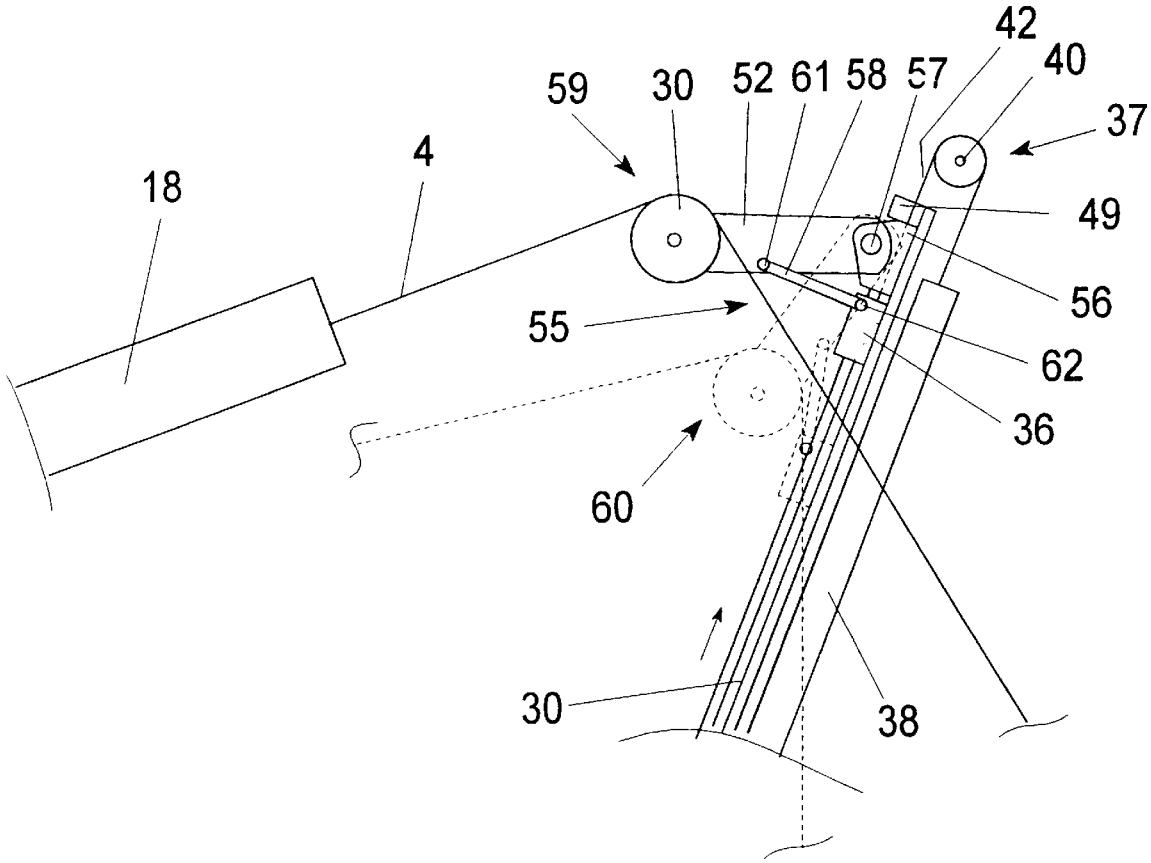
Fig.4.1

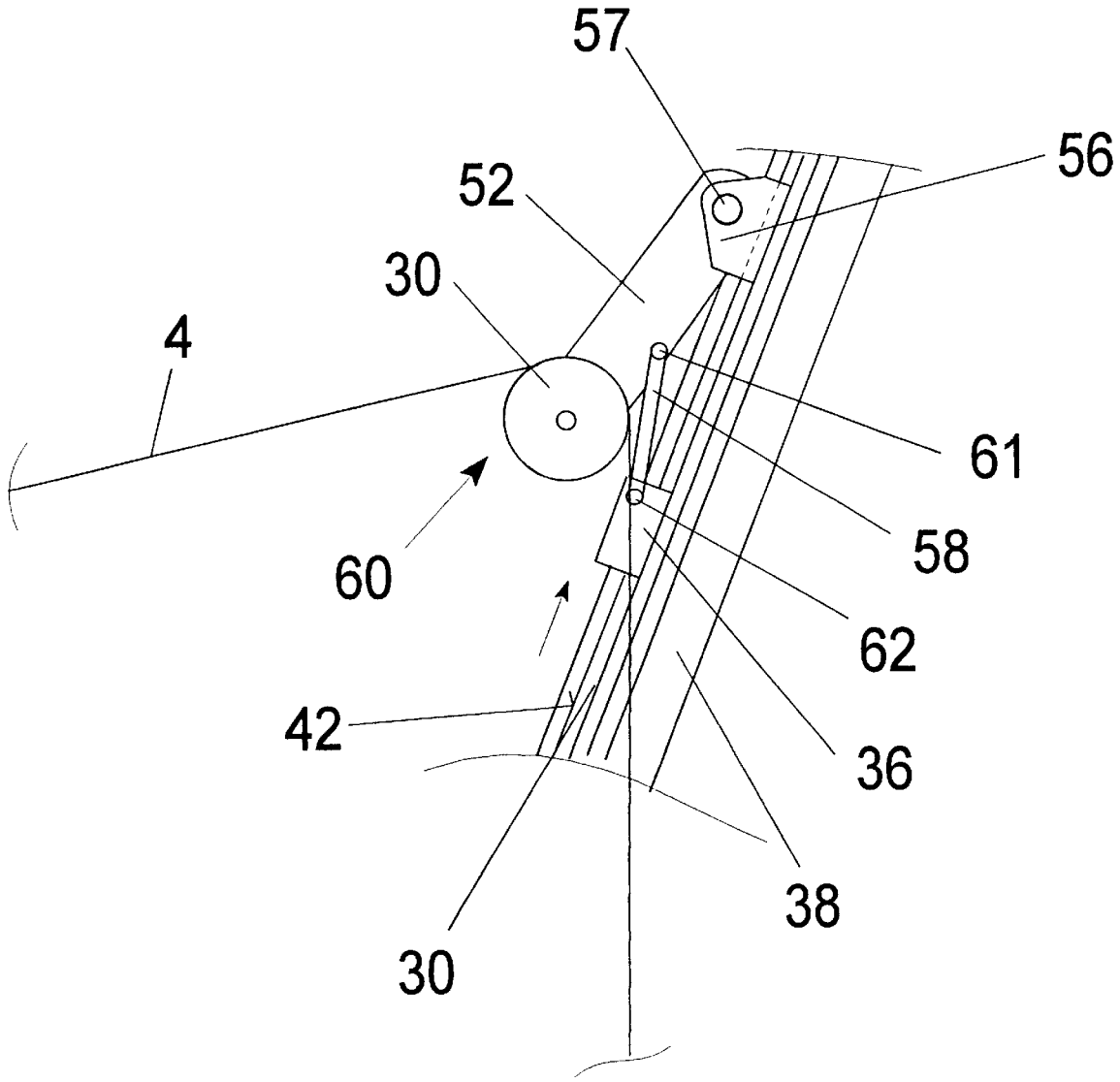
Fig.4.2

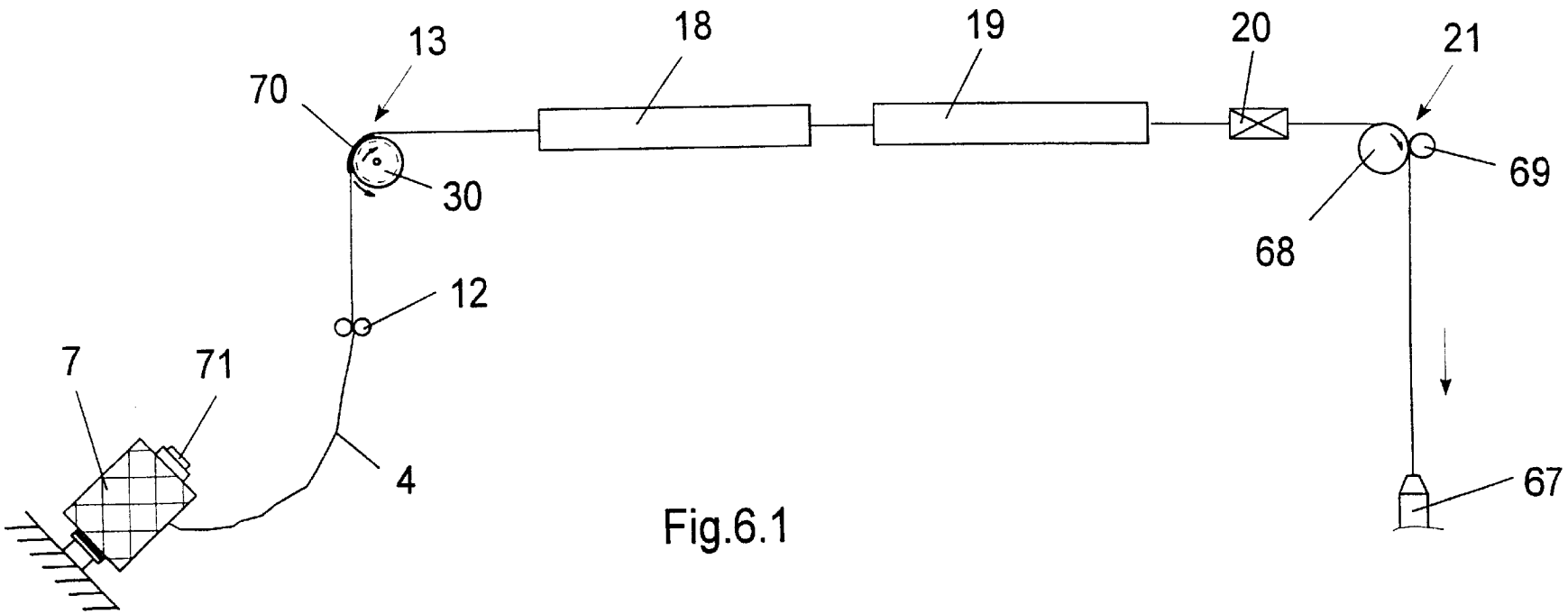
Fig.6.1

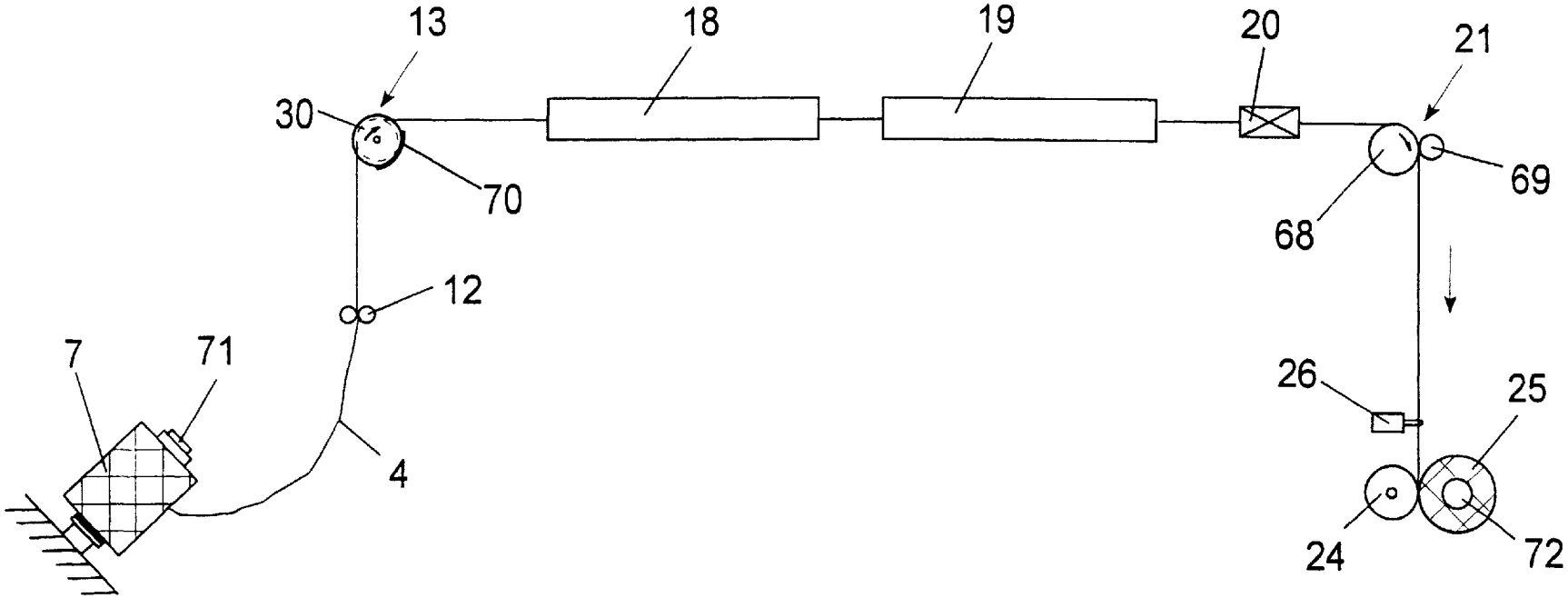
Fig.6.2

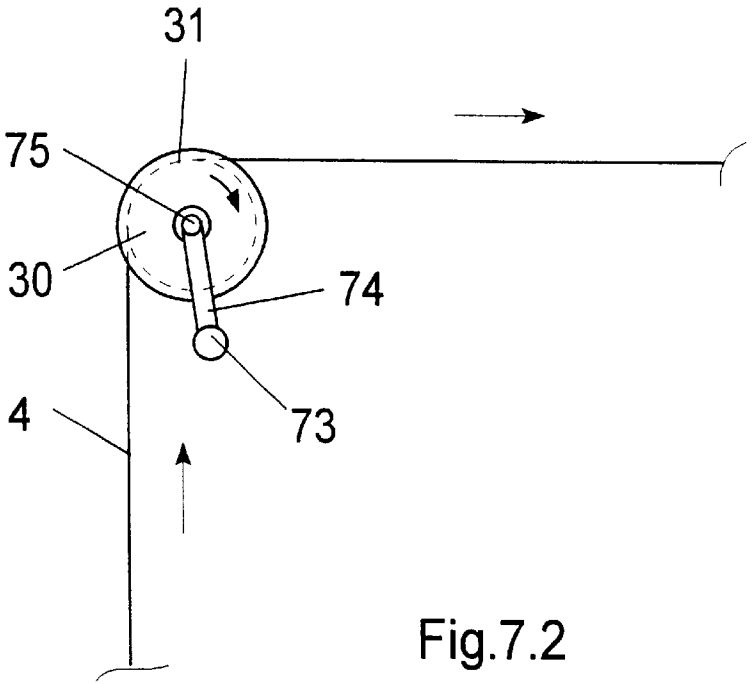
Fig.7.2
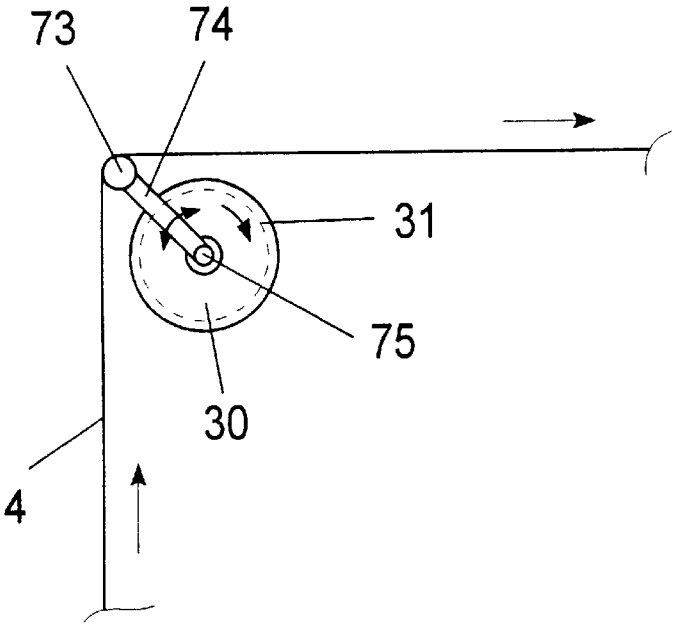
Fig.7.1

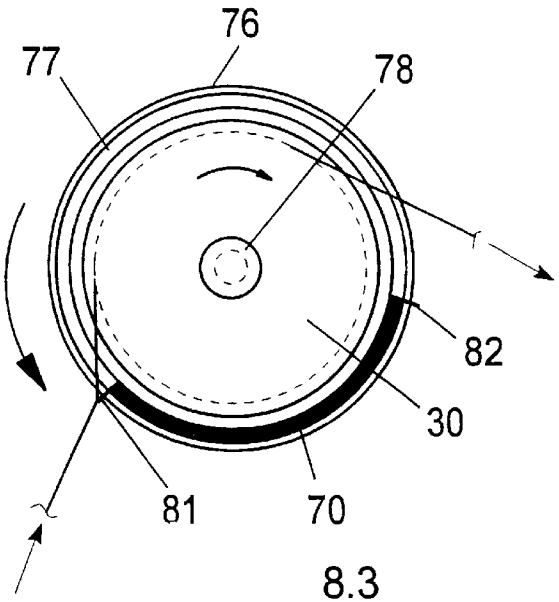
8.3
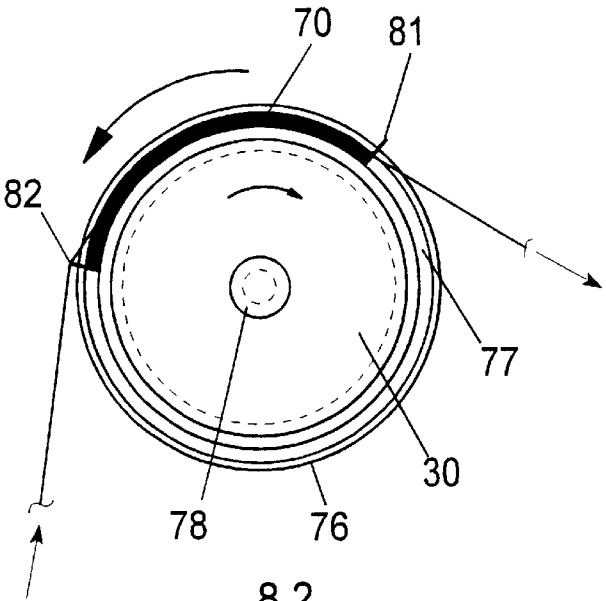
8.2
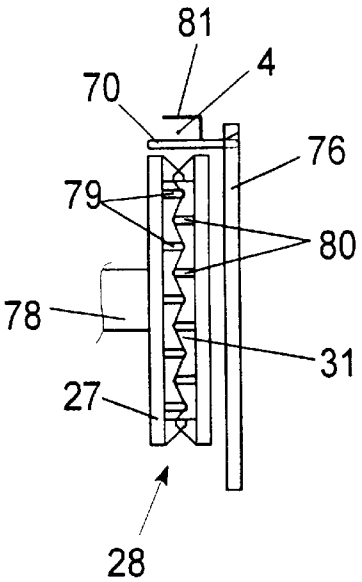
8.1

YARN TEXTURING MACHINE

CROSS-REFERENCE TO RELATED APPLICATIONS

This application is a divisional of application Ser. No. 09/590,237 filed Jun. 8, 2000, which in turn is a continuation of PCT/EP99/07289, filed Oct. 1, 1999.

BACKGROUND OF THE INVENTION

The invention relates to a yarn texturing machine of the type disclosed in WO 98/33963 and corresponding U.S. Pat. No. 6,209,302.

In the known texturing machine, a plurality of feed yarn packages are arranged in a creel frame, one on top of the other. Each feed yarn package supplies a yarn to a processing station in the machine. For unwinding and for advancing and possibly drawing the yarns, a plurality of feed systems are arranged in the machine, one after another. In this arrangement, the first feed system is arranged above the creel frame to withdraw the yarn from the feed yarn package and to advance it into a false twist texturing zone. This arrangement permits advancing the yarn without deflection from the feed system directly to a heating device within the false twist texturing zone. However, at the beginning of the process, it is necessary that for threading the yarn, the feed system be moved from its operating position to a servicing position. To this end, the feed system is mounted on a slide, which can be moved by means of a linear drive along a guide rail. In so doing, it is necessary to overcome considerable differences of height between the upper operating position and the lower servicing position. This requires a transfer of a large force for the movement of the slide with the feed system. Furthermore, it is necessary that the feed system be very accurately positioned in its operating position, so that the advance of the yarn in the downstream heating device can take a desired course for the treatment of the yarn.

Furthermore, the two feed systems may be driven at a speed difference, with the first feed system being operated at a lower speed in relation to the second feed system. In the known texturing machine, the feed system upstream of the texturing zone is designed and constructed as a feed roll, which advances the yarn by friction, substantially without slip, in a track extending on its circumference. To apply to the yarn the frictional force needed for the advance, it is necessary to have a minimum looping on the circumference of the feed roll as well as a yarn track for a transverse deflection of the yarn in the looping region. However, such a design and construction of the feed system requires in a first threading of the yarn, a minimum yarn tension for inserting the yarn into the track of the feed roll. Furthermore, the speed difference between the adjacent feed systems, as well as the friction exerted by the feed roll on the yarn during its threading lead to substantial differences in the yarn tension. However, the threading of the yarn, during which the speeds of the feed systems are varied, is possible only to a limited extent, when the drives of the feed systems of adjacent processing stations are coupled.

It is therefore an object of the invention to further develop the texturing machine of the initially described kind such that an operator can perform the vertical adjustment of the feed system and the threading of the yarn without significant physical effort. Furthermore, it is the object of the invention to create a texturing machine, wherein upon reaching the operating position of the feed system, the yarn can be gently threaded in a processing station of the texturing machine despite speed differences in the feed systems and without significant changes in the yarn tension, and wherein it can be gently inserted into the heating device.

SUMMARY OF THE INVENTION

The above and other objects and advantages of the present invention are achieved by the provision of a yarn texturing machine which comprises a plurality of serially arranged yarn feed systems. At least one of the feed systems comprises a driven feed roll which is partially looped by the advancing yarn so as to advance the yarn by friction in a guide track on the feed roll. A guide member is mounted for movement relative to the feed roll so as to vary the extent of the looping between a threading position and an operating position. In the threading position, the yarn does not contact the feed roll, and in the operating position the yarn is in contact with the feed roll.

The one yarn feed system may also comprise a slide which is displaceable along a guide rail between a servicing position and an operating position. The slide is guided along the guide rail by means of a slide element which slideably engages the guide rail. Also, a drive is coupled to the slide or the slide element via a connecting means, so as to move the slide between the two positions.

The texturing machine of the present invention distinguishes itself in that irrespective of its positions, the feed system can be guided along the guide rail with a uniform stability. The yarn may advance in the feed system already in the servicing position, since the transverse forces that are transmitted by the yarn to the feed system, are safely absorbed by the guided slide, when the feed system is moved.

The connecting means between the drive and the slide element is designed and constructed such that until the operating position is reached, it ensures a reliable guidance of the slide element in the guide rail, and a transfer of force for a uniform movement.

In a particularly advantageous further development of the invention, the connecting means is formed by a magnetic piston, which is guided in a cylinder by means of compressed air, and which connects to the slide element by magnetic forces. The direct connection between the slide element and the piston controlled by the drive makes it possible to position the slide and thus the feed system in a very accurately reproducible manner, which stabilizes the yarn advance in the operating position.

The combination of a cable line and the drive allows large weights and long distances to be handled in an advantageous manner. To this end, the slide element guides the slide with the feed system along the guide rail. The drive is preferably connected to the slide element, via a cable line, which extends along the guide rail. Thus upon actuation of the drive, only one force acts upon the slide element in the direction of movement. The force is transmitted by the cable line, thereby eliminating disturbance variables by transverse forces. Preferably, the drive is formed by a piston-cylinder unit, wherein the piston in the cylinder is controlled by compressed air. With that, it is possible to move the feed system fast and precisely between the lower servicing position and the operating position. However, it is also possible to hold the feed system in an desired position between the servicing and the operating position. Such a holding position can be realized by applying pressure to both sides of the piston within the cylinder.

To enable a sensitive control of the movement of the slide, the cable line may comprise two cables, which are connected to the opposite ends of the slide element, and guided to the cylinder respectively over an upper and a lower pulley. The cylinder extends parallel to the guide rail, so that the cables each extend into the cylinder through an inlet provided at each end of the cylinder, and connect to the opposite ends of the piston.

To avoid major pressure losses while controlling the cylinder, it is proposed to arrange a seal in each inlet of the cylinder, through which the cable extends.

According to one specific embodiment, a control valve is used for controlling the piston-cylinder unit. The control valve is designed and constructed such that the piston is controllable both in its direction and in its speed, so that the movement of the slide element is variable in its direction of displacement and in its speed of displacement. This development is especially of advantage for moving the feed system into its operating position. In this connection, it is possible to reduce the speed of displacement shortly before reaching the operating position, so that a slow and, thus, safe entry into the operating position is possible. This is especially advantageous for inserting the yarn into the heating device. In such texturing machines, it is preferred to use heating devices, in which the heating surfaces have a temperature that is higher than the melt point of the yarn material. Thus, it is possible to avoid by the slow entry into the operating position that the yarn comes into an unacceptable contact with the heating surface and thereby melts or burns.

In a further development of the texturing machine according to the invention, the slide with the feed system connects to the slide element by a pivoting means. In this instance, the slide can be pivoted in the operating position by the pivoting means from a sliding position to a deflected position, and vice versa. This development provides a further solution to the underlying problem. The special advantage of this feature lies in that in the deflected position of the slide, the feed system has reached its final operating position. With that, it is possible, for example, to insert the yarn into the heating device alone by adjusting the slide between the sliding position and the deflected position. The movement of the pivot mechanism may be controlled, for example, by moving against a stop or by a separate drive. Furthermore, it is possible to influence thereby the yarn looping, so that the looping friction on the feed system, which is necessary for advancing the yarn, is reached only in the deflected position.

In this embodiment, a push element is mounted next to the slide element for sliding on the guide rail. The slide element and the push element connect to the slide by the pivot mechanism. The movement of the pivot mechanism is effected by a relative movement between the slide element and the push element on the guide rail. This permits controlling the pivot mechanism in its movement by the linear drive, so that both the vertical adjustment and the swing motion of the feed system can be performed by a simple manipulation.

To realize a possibly compact structural unit, it is proposed to construct the pivot mechanism as a simple push crank. To this end, the slide connects, via a pivot axle, to the push element. Between the slide element and the slide, a rocking arm extends with pivot joints. This permits turning the slide about the pivot axle by a relative movement between the slide element and the push element.

The relative movement between the push element and slide element is easy to realize by simply blocking the nondriven element relative to the driven element. In the present case, the slide element connects to the linear drive, so that for releasing the relative movement, the push element must be blocked on the guide rail.

To this end, a stop is provided at the end of the guide rail, which the push element reaches in the operating position. Once the push element engages the stop, the continued drive of the slide element by the linear drive leads to a deflection of the slide guided on the rocking arm. In this instance, it will be especially advantageous, when the push element precedes the slide element on the guide rail in the direction of movement to the operating position. This permits securing the deflected position by the contact of the slide element with the push element.

Preferably, the pivot mechanism assumes in the deflected position of the slide in relation to the slide element and the push element, such a position that the transmitted forces lead to an automatic over-the-center locking of the slide element and the push element on the guide rail. Thus, the feed system is securely locked in its operating position. The automatic locking will release only when the slide element is activated by the linear drive to move to the servicing position.

In the texturing machine of the present invention, the feed system may be vertically adjusted with or without the drive of the feed system. In the case that the drive is mounted to the slide together with the feed system, and adapted for moving from the operating position to the servicing position, the drive may be designed to connect in the operating position to an energy supply outlet. Depending on the construction of the drive, it is thus possible to provide a connection between a source of energy and the drive by means of a mechanical coupling or an electrical plug contact.

In a particularly advantageous further development of the texturing machine, the feed system is designed and constructed as a feed roll, which comprises on its circumference a zigzag yarn guide track. Such a feed roll is known, for example, from DE 196 52 620. To reach the speed of advance, it is necessary that the yarn loop about the feed roll to a certain degree. Thus, it is possible to influence with advantage the degree of looping about the feed roll by adjusting the slide between the sliding position and the deflected position. The deflected position thus requires a large looping, whereas the sliding position needs only little looping, which must facilitate only a threading of the yarn in the servicing position.

With the use of a feed roll, it is known that a feed roll advances the yarn without slip, only when the frictional forces acting upon the yarn are sufficiently high. In this connection, the frictional forces are produced by the yarn loopings about the feed roll and guide elements of the feed roll. If the frictional forces are too low, a slip will occur between the yarn and the feed roll, i.e., the yarn will slide relative to the contact surfaces of the feed roll. This effect is now being used in particular for threading the yarn, and leads to a further solution to the underlying problem. To this end, when a yarn is threaded by means of a guide member in a processing station of the texturing machine according to the invention, the yarn is initially advanced by at least one adjacent feed system without contacting the guide track on the circumference of the feed roll. In this phase, the yarn advances at a speed, which is determined by the adjacent feed system. For drawing the yarn, the speeds of the feed systems differ, so that a draw tension is able to build up in the yarn. The speed difference or the draw tension is slowly built up by moving the guide member, until the guide member reaches the operating position. This allows a sudden deceleration or an acceleration to the differential speed of the adjacent feed system to be avoided. This solution also has the advantage that it thus facilitates threading in a stationary feed system.

In a particular advantageous further development of the invention, the guide member advances the yarn only in its threading position. In the operating position of the guide means, the yarn is advanced exclusively by the feed roll. The guide member has no contact with the yarn. This development has the advantage that no additional yarn deflection and, thus, no looping friction by the guide means occur, while the yarn is being processed. By the movement of the guide member, the yarn is transferred to the feed roll.

To deflect the yarn as little as possible in the threading position, the guide member takes the form of a threading plate which is arranged in spaced relationship with the feed roll, so as to cover the yarn track and, thus, the guide elements of the feed roll. In the threading position, the yarn is thus guided on the surface of the threading plate.

A particularly compact construction, as well as a particularly gentle yarn guidance can be realized wherein, in relation to the feed roll, the threading plate exhibits a similar curvature, so that in the threading position, the deflection of the yarn can be made uniform and especially small over the entire looping range. The movement of the threading plate in the circumferential direction of the feed roll effects in addition a gentle entry of the yarn into the guide track of the feed roll.

To be able to influence the degree of the yarn looping on the threading plate in the threading position or the degree of the yarn looping about the feed roll in the operating position, it is proposed to mount on the threading plate an inlet yarn guide and an outlet yarn guide, which face each other at a distance in the circumferential direction of the feed roll.

The movement of the guide member can be realized in a simple manner by a rocking arm. This rocking arm is mounted with its one end in a pivot bearing.

A particularly advantageous development of the texturing machine according to the invention provides for a guide arrangement, which comprises a guide groove concentric with the circumference of the feed roll. In this guide groove, the guide means extends between the threading position and the operating position.

In this development, the movement of the guide member may be performed both by an independent drive or by auxiliary yarn threading devices.

BRIEF DESCRIPTION OF THE DRAWINGS

In the following, further advantages as well as other embodiments of the invention are described in greater detail with reference to the drawings, in which:

FIGS. 4.1 and 4.2 are each a schematic view of a further embodiment of a height adjustable feed system;

FIGS. 6.1 and 6.2 illustrate a further embodiment of a texturing machine according to the invention;

FIGS. 7.1 and 7.2 illustrate a further embodiment of a feed roll with a guide member; and FIGS. 8.1, 8.2, and 8.3 illustrate a further embodiment of a guide roll with a threading plate.

DETAILED DESCRIPTION OF THE PREFERRED EMBODIMENTS

Figure 1:
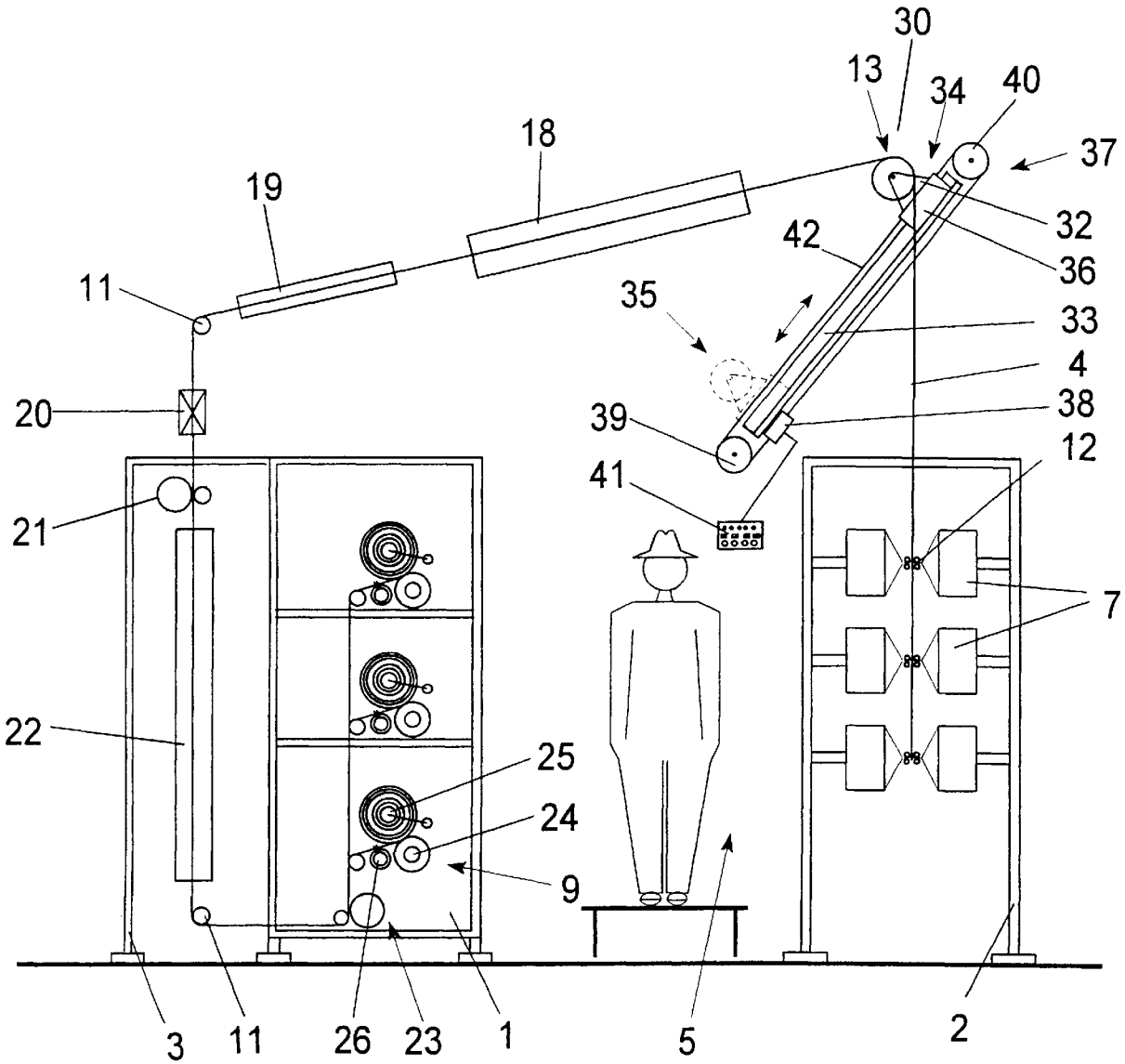
FIG. 1 is a schematic view of a texturing machine according to the invention.

FIG. 1 is a schematic view of an embodiment of a texturing machine according to the invention. The Figure shows one machine half of a partially automated false twist texturing machine. Since both machine halves adjoin each other in mirror inverted manner, only one half of the double machine is shown in FIG. 1 and described with reference thereto.

The machine comprises a creel frame 2 and a takeup frame 1. The creel frame 2 accommodates a plurality of feed yarn packages 7 overlying one another in tiers. An operator/doffing aisle 5 is formed between the creel frame 2 and the takeup frame 1. Above the machine frames, a first feed system 13, a heater 18, and a cooling device 19 extend in one plane. A false twist unit 20 and a second feed system 21 are supported on a process frame 3. The process frame 3 is arranged on the side of the takeup frame 1 opposite to the creel frame 2. The takeup frame 1 and the process frame 3 directly abut each other. The process frame 3 accommodates a second heater 22 downstream of the second feed system 21. The takeup frame 1 serves to support several takeup devices 9. Likewise in this instance, a plurality of takeup devices overlie one another in tiers. Each of the takeup devices winds the yarn to a package 25. The yarn package 25 is arranged on a spindle, which is driven via a friction roll 24. Upstream of the yarn package, a yarn traversing device 26 extends in the path of the yarn. A third feed system 23 extends upstream of the takeup devices 9.

In this arrangement, the first feed system 13 withdraws the yarn 4 from the feed yarn package 7 via a yarn guide 12, and advances it into the false twist texturing zone. The false twist texturing zone is defined by the false twist unit 20 and the feed system 13. Within the false twist texturing zone, the heater 18 and cooling device 19 extend in one plane. At the outlet of the false twist texturing zone, the second feed system 21 is arranged for withdrawing the yarn from the false twist texturing zone and advancing it into the second heater 22. The first feed system 13 and the second feed system 21 operate at a speed difference, so that the yarn is simultaneously drawn within the false twist texturing zone. From the second heater 22, the third feed system 23 withdraws the yarn 4 and advances it to one of the takeup devices, where the yarn is wound to a package 25. After the packages 25 are fully wound, a doffer performs a package doff on the false twist texturing machine. To this end, the full packages are removed from the takeup device 9, and new empty tubes are inserted. During this time, a suction system takes in the yarn and advances it to a waste container.

For an aftertreatment of the yarn in the second heater 22, it is also advantageous to arrange a further feed system between the second feed system 21 and the inlet of the heater 22. With this further feed system, it is possible to adjust a speed difference between the feed system upstream the second heater 22 and the third feed system 23.

In the embodiment illustrated in FIG. 1, the feed systems 21 and 23 are stationarily arranged in the machine. The feed systems 21 and 23 may be constructed, for example, as nip-type feed systems with a shaft and a pressure roll or pressure belt in contact therewith. The first feed system 13 is formed by a feed roll 30, as is known from DE 196 52 620. To this extent, this publication is herewith incorporated by reference. The feed roll 30 is mounted with a motor (not shown) to a height adjustable slide 32. Since the feed system 13 is arranged above the creel frame 2 in a position that is unreachable for an operator, it is possible to move the feed roll 30 with the slide 32 along a guide rail 33 between an illustrated operating position 34 and a servicing position 35 (shown in phantom lines), which is arranged below the operating position 34. To this end, the slide 32 connects to a slide element 36. The slide element 36 is guided along the guide rail 33. A cable line 37 extends in the plane of movement of slide element 36. The cable line 37 connects the slide element to a drive 38. The drive 38 can be manually activated via a control unit 41, so that the slide element 36 and, thus, the slide 32 move with the feed system 13 along the guide rail 33. The cable line 37 may consist, for example, of a cable 42, that is attached with its ends to the slide element 36. At the ends of guide rail 33, the cable 42 deflects over pulleys 39 and 40, and connects to drive 38. The drive 38 moves the cable in the direction parallel to the guide rail, so that the slide element 36 is displaced with the slide 32 and feed system 13. The drive 38 is manually activatable via a control unit 41. In this connection, it is possible to use an electric, an electromechanical, or a pneumatic drive for actuating the cable line.

For threading a yarn 4 in a processing station, the yarn 4 is taken in by a hand-operated suction gun. An operator guides the yarn into the individual processing stations. To this end, the first feed system 13 is guided to its lower servicing position 35. In its servicing position, the feed system 13 is no longer driven. Thus, the yarn 4 slides at the suction speed across the feed surfaces of the feed roll 30. When a feed roll 30 is used, which guides the yarn in zigzag form on a circumferential surface, the yarn slides over the guide elements on the circumference of the feed roll 30. After threading the yarn, the feed system 13 is moved from its servicing position 35 to its operating position 34 by activating the drive 38. In the operating position 34, the drive of feed roll 30 is activated, so that the yarn 4 is advanced by the feed system 13.

As regards its frame layout, the texturing machine of FIG. 1 is shown by way of example. The creel frame 2, the takeup frame 1, and the process frame 3 can be combined in different ways. It is possible to form a further operator aisle between the process frame and the takeup frame 1. Likewise, it is possible to construct the machine fully automatic, so that the package doff occurs in the machine automatically. Likewise, it is possible to make the second feed system 21 and/or the third feed system 23 movable, because the invention is not limited to having to overcome a difference of height between the operating position and the servicing position. Rather, for threading the yarn from an accessible region, the invention makes it possible to construct each feed system for movement to a region that is easy to reach for an operator. In this connection, it will be advantageous to construct the second and/or the third feed system likewise as a feed roll.

In the following illustrated embodiments, components with the same functions are indicated by identical numerals for the sake of clarity.

Figure 2:
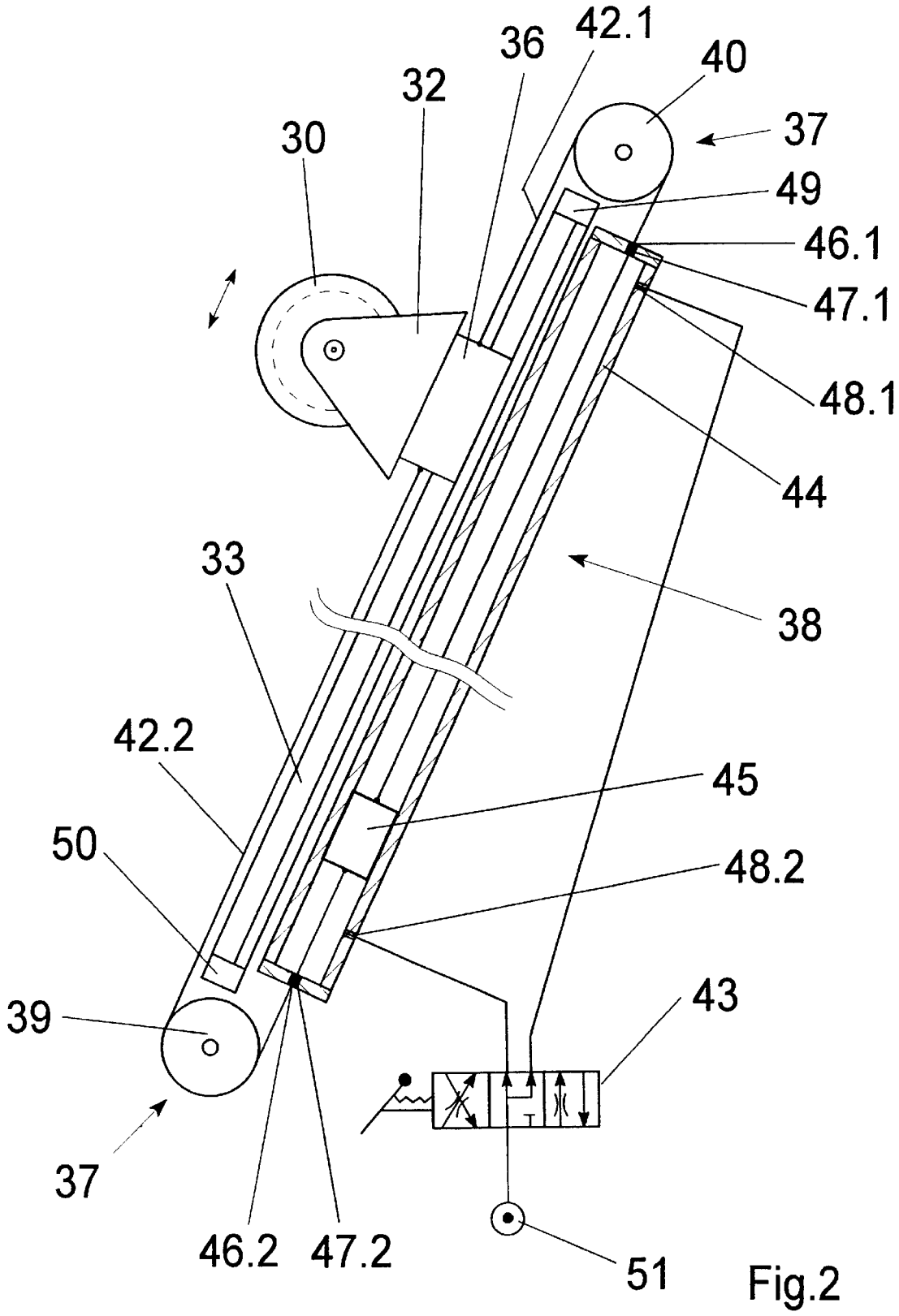
FIGS. 2 and 3 are each a schematic view of further embodiments of a height adjustable feed system.

FIG. 2 illustrates a further embodiment of a displaceable feed system, as can be used in the texturing machine of FIG. 1. The feed system is formed by a feed roll 30 rotatably mounted to the slide 32. An electric motor not shown drives the feed roll 30. The electric motor is likewise mounted to the slide 32, and may be supplied, for example, by an energy chain. However, it is also possible to connect the electric motor in the operating position, via a plug contact, to a an energy supply outlet.

The slide 32 connects to a slide element 36. The slide element 36 is guided along a profiled guide rail 33. At its ends, the guide rail 33 possesses a stop 49 and 50, respectively. The stop 49 and stop 50 are arranged in the path of movement of slide element 36, and, when contacted by the slide element 36, they define a servicing position and an operating position. The slide element 36 connects to the drive 38 via a cable line 37. The drive 38 is constructed as a cylinder-piston unit, with a cylinder 44 extending substantially parallel over the length of the guide rail 33. A piston 45 is arranged in the cylinder 44. At its front ends, the piston 45 rigidly connects to respectively one cable 42.1 and 42.2 of the cable line 37. The cable 42.1 extends outward from the cylinder 44 through an inlet 46.1 formed at the end of cylinder 44, and is deflected over a pulley 40. The pulley 40 is arranged on one end of the guide rail 33. The deflected end of the cable 42.1 is attached to the slide element 36.

The cable 42.2 attached to the opposite front end of the piston 45, extends outward through an inlet 46.2 provided at the opposite end of the cylinder 44, and it is deflected over a pulley 39 arranged in the end region. The other end of cable 42.2 is attached to the slide element 36. Thus, the slide element 36 and the piston 45 are connected via the tensioned cables 42.1 and 42.2.

In each of its end regions, the cylinder 44 comprises a compressed air connection 48.1 and 48.2. The compressed air connections 48.1 and 48.2 connect via lines to a control valve 43. The control valve 43 connects to a source of compressed air 51, so that by actuating the control valve 43, it is possible to bias the piston 45 with compressed air alternately on one side or simultaneously on both sides. For example, when the upper chamber of the cylinder 44 receives compressed air, the control valve 43 will have to be moved to a left switching position. In this switching position, the piston 45 moves, because of the pressure gradient in the cylinder 44 toward the inlet 46.2. Thus, by the transmission to the cable line 37, the slide element 36 moves in the direction of stop 49. To avoid major pressure losses, the inlet 46.1 is provided with a seal 47.1, through which the cable 42.1 extends. Accordingly, the inlet 46.3 contains a seal 47.2, through which the cable 42.2 extends.

However, it is also possible that the piston is formed by a magnet, which controls a ring segment on the circumference of the cylinder via a magnetic hold. In this instance, it would be possible to attach the cables 42.1 and 42.2 to the ring segment. Such an arrangement has the advantage that no compressed air losses develop.

Advantageously, the cable line 37 shown in FIG. 2 may also be supplemented with a plurality of deflection pulleys. Likewise, it is possible to make the cables 42.1 and 42.2 as segments of a continuous cable.

Figure 3:
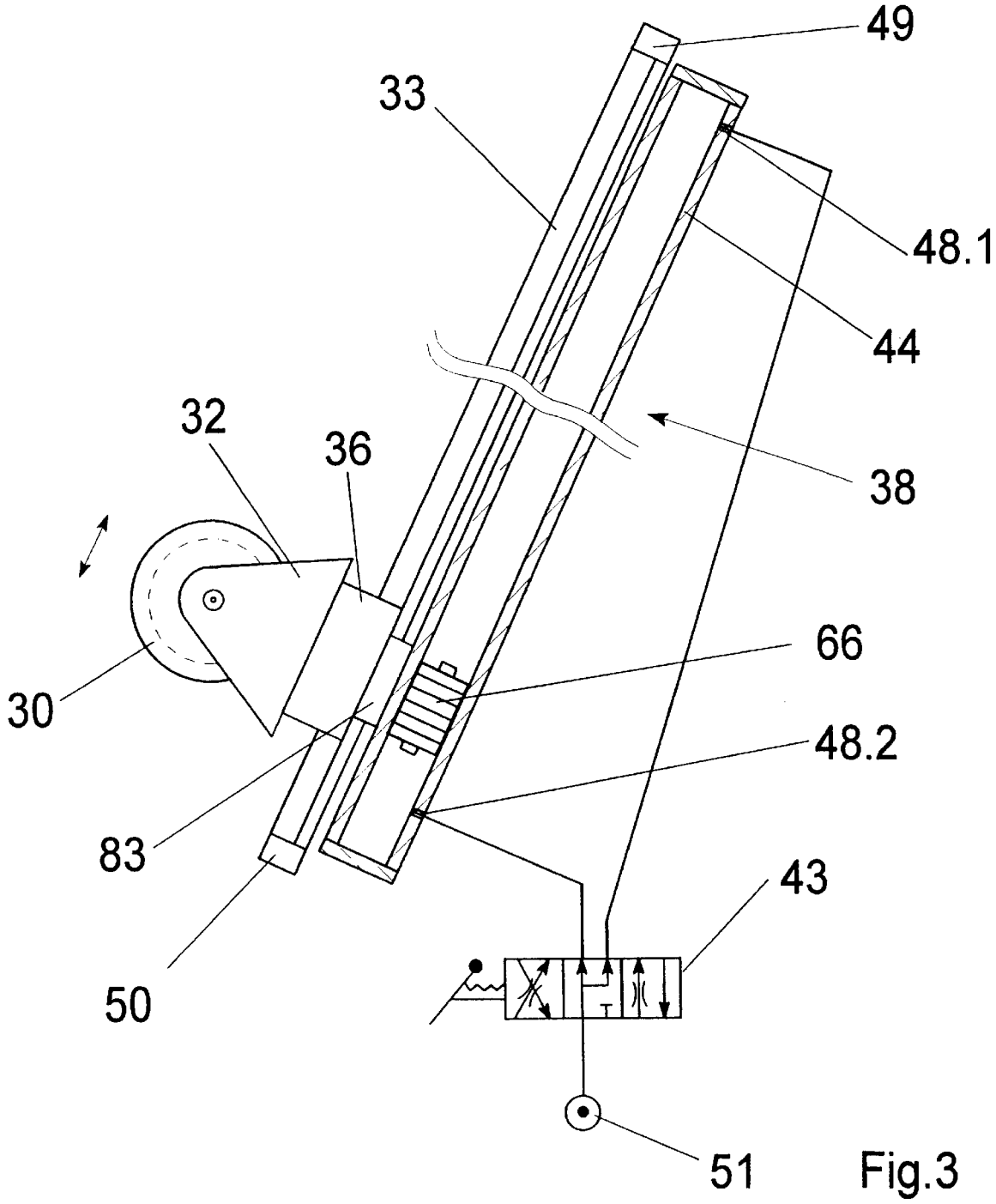

FIG. 3 illustrates a further embodiment of a displaceable feed system. The illustrated arrangement differs from the feed system shown in FIG. 2 in the design and construction of the connecting means between the slide element 36 and the drive 38. The slide 32 is guided via the slide element 36 in the profiled guide rail 33. Parallel to the guide rail 33, a pneumatic drive 38 is arranged. The drive 38 is designed and constructed as a cylinder-piston unit, wherein the cylinder 44 extends substantially parallel to the length of guide rail 33. A magnetic piston 66 extends in cylinder 44. On the outside of the cylinder 44, the slide element 36 mounts a magnetizable slide shoe 83. The slide shoe 83 connects via magnetic forces to the magnetic piston 66 in the interior of cylinder 44, so that the movement of the magnetic piston 66 causes the slide shoe 83 to slide along the cylinder wall and, thus, the slide element 36 along the guide rail 33.

The movement of the magnetic piston 66 is controlled via the control valve 43. On its one side, the control valve connects to a source of pressure 51, and on its opposite side to respectively one end of the cylinder 44. By actuating the control valve 43, it is possible to bias the magnetic piston 66 with compressed air alternately on one side or simultaneously on both sides.

Figure 5:
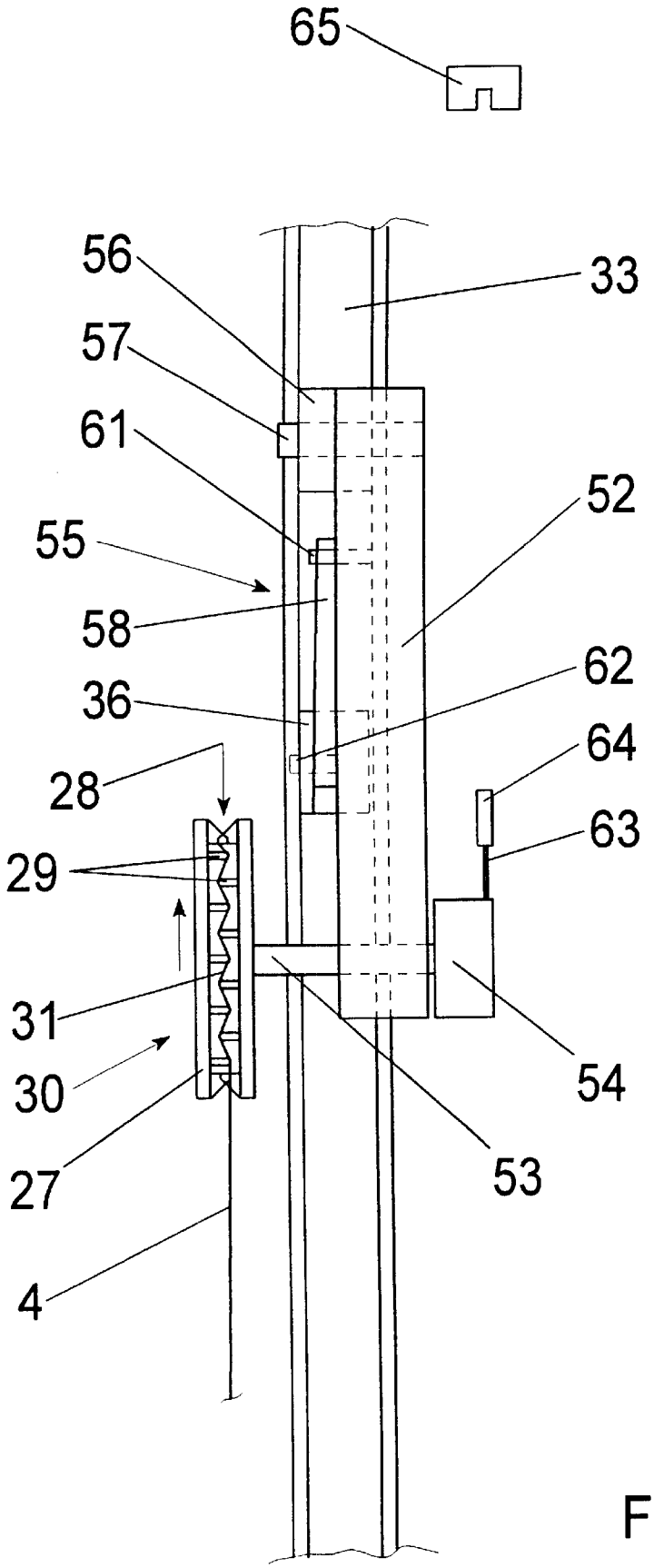
FIG. 5 is a schematic top view of the height adjustable feed system of FIG. 4.

FIGS. 4.1, 4.2 and 5 illustrate a further embodiment of a displaceable feed system, as could be used, for example in a texturing machine of FIG. 1. FIG. 4.1 shows the feed system in its operating position with the slide extended in the deflected position. FIG. 4.2 shows the feed system with the slide retracted in the sliding position. FIG. 5 is a top view of the feed system in the sliding position shortly before reaching the operating position. Unless otherwise specified, the following description will apply to FIGS. 4.1, 4.2, and 5.

A slide 52 rotatably mounts the feed roll 30. The slide 52 connects via a pivot mechanism 55 to a slide element 36 and a push element 56. In the embodiment, the pivot mechanism 55 comprises a pivot axle 57, which connects the slide 52 for pivotal movement with the push element 56. Between the slide element 36 and the slide 52, a rocking arm 58 is provided, which connects in its end regions, via a pivot joint 61 to the slide 52 and via a pivot joint 62 to the slide element 36. The slide element 36 and the push element 56 are arranged in spaced relationship. In this arrangement, the pivot joint 61 is located on the slide 52 between the slide element 36 and the push element 56. The slide element 36 and the push element 56 extend one after the other in a guide rail 33, with the slide element 36 being connected via a cable line 37 to the drive 38. The cable line 37 and the drive 38 may be designed and constructed corresponding to the embodiment shown in FIG. 2. To this extent, the description of FIG. 2 is herewith incorporated by reference.

The guidance of the slide 52 along the guide rail 33 occurs in the position shown in FIG. 5. In this sliding position, the push element 56 and the slide element 36 are spaced from each other so far that the pivot joint 61 is located on the slide 52 in a plane transverse of the guide rail 33 between the slide element 36 and the push element 56. In this position, the slide element 36 is moved via the cable line 37. The force of the weight of feed roll 30 and slide 52 exerts, via the components of the pivot mechanism, a pushing force on the push element 56, so that the push element 56 moves along the guide rail 33 in the same direction as the slide element 36. The end of guide rail 33 mounts a stop 49, which secures the operating position. As the sliding movement continues, the push element 56 contacts the stop 49. This blocks the further movement of the push element 56. However, the linear drive and the cable line 37 continue to move the slide element 36 in direction toward the stop 49. This produces a relative movement between the push element 56 and the slide element 36 along the guide rail 33. The relative movement results in that the rocking arm 58 pivots the slide 52 out of its sliding position 60. In this connection, the length of the pivot arm 58 is dimensioned such that the continuing movement causes the slide element 36 to contact the push element 56. As a result, the feed system or slide 52 reaches a deflected position 59. In this situation, the pivot joint 61 is located between the rocking arm 58 and the slide 52 in a plane transverse of the guide rail, which extends below the slide element and the push element. This construction of the pivot mechanism accomplishes that the weight force acting upon the slide element produces a holding force operative in the direction of the stop 49, thus effecting an automatic locking of the slide element and the push element of the guide rail.

FIG. 4.1 also shows the inlet of the heater 18 as well as the path of the yarn 4 in the texturing machine. As can be noted therefrom, the yarn 4 is inserted into the heater 18 only in the deflected position 59 of the feed system. In the sliding position 60, the yarn 4 is still outside of the heater despite the fact that the operating position has been reached. With that it is possible to effect a gentle insertion and a rapid removal of the yarn 4 from the heater 18.

In FIG. 5, the feed roll is designed and constructed as a disk 27. On its circumference, the disk 27 is provided with a U-shaped groove 28. In the U-shaped groove 28, a plurality of guide elements 29 are alternately arranged on the groove bottom, so that they form on the groove bottom a zigzag yarn guide track 31 that extends over the circumference of disk 27. The feed roll rigidly connects to a drive shaft 53, which is driven by an electric motor 54. The motor 54 comprises a rigid line 63, whose free end mounts a plug 64. In the operating position, the plug 64 can be connected to an electrical energy supply outlet 65. This plug connection connects the motor 54 to a source of current. The drive shaft 53 is driven for rotation, so that the feed roll 30 advances a yarn 4 inserted into the guide track 31. The surfaces of the guide elements 29 of the feed roll 30 are designed and constructed such that the friction generated by the yarn 4 prevents the yarn from sliding on the circumferential surface of the disk 27. Thus, the yarn 4 is imparted a speed that is predetermined by the speed of the feed roll 30. 27. The feed roll rigidly connects to a drive shaft 53, which is driven by an electric motor 54. The motor 54 comprises a rigid line 63, whose free end mounts a plug 64. In the operating position, the plug 64 can be connected to an electrical energy supply outlet 65. This plug connection connects the motor 54 to a source of current. The drive shaft 53 is driven for rotation, so that the feed roll 30 advances a yarn 4 inserted into the guide track 31. The cover of the guide elements 29 of the feed roll 30 is designed and constructed such that the friction generated by the yarn 4 prevents the yarn from sliding on the circumferential surface of the disk 27. Thus, the yarn 4 is imparted a speed that is predetermined by the speed of the feed roll 30.

The pivot mechanism shown in FIGS. 4.1, 4.2 and 5 for pivoting the feed system in the operating position is only exemplary. Basically, any pivot mechanism that transmits a rotating motion is possible between the slide and the slide element. For example, a rocking arm that connects in the pivot joints to the slide and the slide element accomplishes a rotating motion of the slide. To this extent, the rocking arm connects to a projection extending beyond the pivot joints, which is caused to move against a stop, so that the rocking arm effects a change in the sliding position. However, it is also possible to provide a pivot mechanism with its own drive for moving the slide or the feed system to the deflected position.

FIGS. 6.1 and 6.2 illustrate a processing station of a further embodiment of a texturing machine. In this connection, FIG. 6.1 shows the processing station during the threading of the yarn, and FIG. 6.2 shows the processing station in operation. Unless otherwise specified, the following description applies to both FIGS. 6.1 and 6.2.

In the processing station of the texturing machine, a feed yarn package 7 is creeled on a mandrel 71. From the feed yarn package 7, a first feed system 13 withdraws the yarn 4. To this end, the yarn 4 advances from the feed yarn package 7 overhead through the yarn guide 12. The feed system 13 is shown in its operating position. A device for vertically adjusting the feed system 13 is not shown, since the present embodiment permits threading the yarn 4 with and without vertical adjustment. The feed system 13 advances the yarn into a false twist texturing zone. The false twist texturing zone comprises a heater 18, a cooling device 19 arranged in the yarn path downstream thereof, as well as a false twist unit 20. At the end of the false twist texturing zone, a second feed system 21 is arranged. In its relation to the first feed system 13, the second feed system 21 is driven at a higher circumferential speed, so that the yarn 4 is drawn in the false twist texturing zone. The second feed system 21 is designed and constructed as a feed shaft 68 with a pressure roll 69 in circumferential contact with the feed shaft 68. In this arrangement, the yarn 4 is nipped and advanced between the driven feed shaft 68 and the following pressure roll 69.

From the second feed system 21, the yarn advances to a takeup device. The takeup device includes a rotatable winding spindle 72, on which a package 25 is wound. The package 25 is driven by a drive roll 24 in circumferential contact therewith. In the yarn path upstream of the package 25, a yarn traversing device 26 is arranged. The traversing device 26 comprises an oscillating yarn guide, which reciprocates the yarn crosswise to its direction of advance, so that a crosswound package is wound.

The first feed system 13 is designed and constructed as a feed roll 30. The feed roll 30 is known from DE 196 52 620, and insofar is herewith incorporated by reference. On its circumference, the feed roll 30 comprises a plurality of guide elements 79 and 80 (note FIG. 8.1), which form a substantially zigzag yarn guide track 31. The yarn 4 advances in this track on the circumference of the feed roll 30. The feed roll 30 is driven, with a frictional force acting upon the yarn as a result of the yarn looping about the circumference of feed roll 30 and about its guide elements 79 and 80. As a result of this frictional force, the yarn advances without sliding on the surface of the feed roll. On the circumference of the feed roll 30, a rotating threading plate 70 is arranged in spaced relationship with the guide elements. The threading plate 70 is movable in the plane of the yarn advance at a distance from the yarn guide track between a threading position and an operating position.

FIG. 6.1 illustrates the threading of yarn 4 in the processing station of the texturing machine. In this process, the yarn 4 is taken in by a suction gun 67. From the suction gun 67, the yarn 4 is pneumatically advanced to a waste container (not shown). The suction gun 67 is guided by an operator. In so doing, the yarn 4 is successively inserted into the individual units of the processing station. FIG. 6.1 illustrates the situation, wherein the yarn has been inserted up to the second feed system 21. In this phase, the feed roll 30 is shielded by the threading plate 70 such that the yarn does not enter the yarn guide track of the feed roll 30. The threading plate 70 is in the threading position. With that, the yarn is withdrawn from the feed yarn package 7 by the feed system 21, and guided along the surface of threading plate 70.

To insert the yarn 4 into the guide track of feed roll 30, the threading plate is turned opposite to the direction of the advancing yarn in the direction of the arrow. In so doing, the looping region on the circumference of feed roll 30 is released along with the progressing movement of the threading plate 70, and the feed roll 30 comes to engage. The yarn 4 is slowed down to the lower speed of the feed system 13, only when a complete looping is reached. When the looping of the yarn 4 about the feed roll 30 is inadequate, the yarn will slide over the contact surfaces of the feed roll 30. Thus, a gradual deceleration proceeds, and with that, a gradual buildup of the draw tension in the yarn.

In the situation shown in FIG. 6.2, the processing station is in operation. In the operating position, the threading plate 70 is outside of the yarn path. The yarn 4 is now withdrawn from the feed yarn package 7 by the feed roll 30, and advanced into the false twist texturing zone. In the false twist texturing zone, the false twist unit 20 imparts to the yarn a false twist, which returns to the feed system 13. As a result, the false twist of the yarn is set in the heater 18 and the subsequent cooling device 19. The yarn 4 leaves the false twist unit 20 substantially untwisted. The feed system 21 operating at a substantially higher speed then advances the yarn 4 to the takeup device. In the takeup device, the yarn 4 is wound to a package.

FIGS. 7.1 and 7.2 illustrates a further embodiment of a feed roll with a guide member, as could be used, for example, in the texturing machine of FIG. 1 or 6. To the side next to the feed roll 30, a pivot bearing 75 is arranged in the axial extension of the feed roll 30. The pivot bearing 75 mounts a rocking arm 74. The rocking arm 74 has a length, which is greater than the radius of the feed roll 30. At the end of the rocking arm 74, a guide member 73 is arranged to project therefrom such that the guide member 73 extends through the plane of the advancing yarn. The guide member 73 may be designed and constructed as a rod or roll.

FIG. 7.1 shows the guide means in the threading position. In this position, the guide member 73 is rotated into the circumferential region of the feed roll 30, about which the yarn loops in operation. During the threading, it is thus possible to guide the yarn 4 over the guide member 73, without the yarn 4 engaging the feed roll 30.

FIG. 7.2 illustrates the situation, wherein the guide member 73 is moved by the rocking arm 74 to an operating position. In this position, the guide member 73 has been moved out the yarn path, so that the yarn 4 enters the guide track 31 of the feed roll 30. In this position, the yarn 4 is advanced by the driven feed roll 30.

It is also possible to rotate the rocking arm 74 opposite to, or in the direction of the advancing yarn, so as to move from the threading position to the operating position. In so doing, the rocking arm is controlled by a drive not shown.

FIGS. 8.1, 8.2, and 8.3 illustrate a further embodiment of a feed roll with a threading plate, as could be used, for example, in the texturing machine of FIG. 1 or 6. In this respect, FIG. 8.1 is a top view, and FIGS. 8.2 and 8.3 are each a side view of the feed roll. Unless otherwise specified, the following description applies to FIGS. 8.1 to 8.3.

By way of example, the feed roll 30 is designed and constructed as a disk 27, which is mounted to the end of a drive shaft 78. The drive shaft 78 is driven by a drive (not shown). The circumference of the disk 27 forms a U-shaped groove 28. In the U-shaped groove 28, guide elements 79 and 80 are arranged alternatingly facing one another in spaced relationship, so that a zigzag yarn guide track 31 is formed on the groove bottom. During its advance by the feed roll 30, the yarn 4 is guided on the groove bottom. Besides the looping friction on the groove bottom, friction occurs between the yarn and the guide elements 79 and 80 in the looping region.

Laterally of the feed roll 30, a guide arrangement 76 extends, which comprises a guide groove 77 concentric with the circumference of the feed roll 30. The guide groove 77 is constructed with a larger diameter than the feed roll 30. A threading plate 70 extends in the guide groove 77. The threading plate 70 is adapted for displacement in the guide groove by the guide arrangement between a threading position and an operating position. The threading plate 70 projects from the guide arrangement 76 and covers the groove 28 of the feed roll. In the circumferential direction with respect to the feed roll 30, the threading plate 70 mounts at its ends respectively an inlet yarn guide 82 and an outlet yarn guide 81. The yarn guides 81 and 82 may be designed and constructed as a simple rod or small rolls.

FIGS. 8.1 and 8.2 illustrate the threading plate 70 in the threading position. In this position, the threading plate 70 extends over the entire looping region of the yarn on the circumference of the feed roll 30. The advancing yarn 4 is guided by the inlet yarn guide 82 at a distance from the threading plate 70. On the takeoff side of the feed roll 30, the yarn is guided between the surface of the threading plate 70 and the outlet yarn guide 81. In this position of the threading plate 70, the feed roll has no effect on the yarn. The yarn 4 is guided on the surface of the threading plate 70. To advance the yarn with the feed roll 30, the guide arrangement 76 turns the threading plate 70 to the operating position (note FIG. 8.3) opposite to the direction of the advancing yarn. In so doing, the yarn 4 will enter the groove 28 or guide track 31, first on the takeoff side of the feed roll 30. The inlet yarn guide 82 loses contact with the yarn 4, and is rotated with the threading plate 70 parallel to the circumference of the feed roll. Once the threading plate 70 is rotated out of the yarn looping region of the feed roll, the yarn 4 fully enters the guide track 31. The yarn 4 is now advanced by the feed roll 30. To maintain a certain looping of the yarn about the feed roll 30, the outlet yarn guide 81 guides the yarn 4 by turning the threading plate 70 in the contact region in direction toward a greater looping. With that, it is possible to increase the yarn looping about the feed roll 30 in an advantageous manner.

In the described embodiments of FIGS. 6.1, 6.2 and 8.1–8.3, the movement of the guide means or threading plate may be performed by a separate drive or by an auxiliary device, for example, combination with the vertical adjustment of the feed system. Even in the case of a manual operation, it is possible to perform with the apparatus of the invention a gentle threading operation in a processing station of a texturing machine. The rotation of the guide means from the threading position already suffices to prevent substantial peaks of the yarn tension during the threading.

Finally, it should be explicitly noted that the invention also covers guide members of the type which guide the yarn with contact both in the threading position and in the operating position.

That which is claimed:

1. A yarn texturing machine for texturing an advancing thermoplastic yarn, comprising a plurality of serially arranged feed systems, with at least one of the feed systems comprising a rotatably mounted feed roll which is partially looped on its circumference by the advancing yarn and so as to advance the yarn by friction in a guide track on its circumference, a drive for rotating the feed roll, and a guide member mounted for movement relative to the feed roll so as to vary the extent of the looping of the yarn about the feed roll between a threading position and an operating position, and wherein in the threading position the yarn does not substantially contact the yarn guide track and in the operating position the yarn is in contact with the yarn guide track so as to advance the yarn by friction.

2. The yarn texturing machine of claim 1, wherein the yarn guide track is formed by a plurality of guide elements disposed to form a U-shaped peripheral groove.

3. The yarn texturing machine of claim 1, wherein in the threading position the guide member is positioned between the yarn and the circumference of the feed roll.

4. The yarn texturing machine of claim 3, wherein the guide member is in the form of a plate which covers at least a portion of the circumference of the yarn guide track which is looped by the yarn.

5. The yarn texturing machine of claim 4, wherein the plate is arcuately curved to follow the circumference of the feed roll, and wherein the plate is moveable in the circumferential direction between the threading and operating positions.

6. The yarn texturing machine of claim 5, wherein the plate mounts an inlet yarn guide and an outlet yarn guide, which are spaced apart in the circumferential direction.

7. The yarn texturing machine of claim 6, wherein the inlet and outlet yarn guides are positioned and configured such that in the threading position the yarn is advanced over at least a portion of the surface of the plate.

8. The yarn texturing machine of claim 7, wherein the inlet and outlet yarn guides are positioned and configured such that in the operating position the yarn is advanced along the yarn guide track of the feed roll.

9. The yarn texturing machine of claim 3, wherein the guide member is mounted to one end of a rocking arm which is mounted at its other end for pivotal movement about the axis of the feed roll.

10. A method of threading a yarn in a processing station of a yarn texturing machine, wherein the yarn is advanced for purposes of being drawn by at least two feed systems driven at a speed difference, the slower feed system being a driven feed roll which is partially looped by the yarn on its circumference, and which advances the yarn by friction in a yarn guide track formed on the circumference, the threading method comprising the steps of advancing the yarn by the faster operating feed system without substantial contact with the feed roll of the slower feed system, and that for engaging the feed roll, a guide member is moved such that the yarn enters the yarn guide track, so that the friction acting upon the yarn by the feed roll increases along with the progressive movement of the guide member to a slipfree advance.

11. A method of threading a yarn in a processing station of a yarn texturing machine comprising the steps of guiding the yarn so as to extend over a guide member which overlies a portion of the periphery of a driven first feed roll so that the yarn has no substantial contact with the first feed roll, then guiding the yarn through a yarn texturing apparatus and then to a driven second feed roll which advances the yarn to a take up device, and then moving the guide member around the periphery of the first feed roll so that the yarn is progressively brought into contact with the periphery of the first feed roll.

12. The method of claim 11 wherein the driven second feed roll is configured to advance the yarn at a speed greater than that of the first feed roll so as to draw the yarn as it advances therebetween.

* * * * *